US011064309B2

(12) United States Patent
Freeman

(10) Patent No.: US 11,064,309 B2
(45) Date of Patent: Jul. 13, 2021

(54) MULTI-TUNED SPEAKER SYSTEM

(71) Applicant: Bose Corporation, Framingham, MA (US)

(72) Inventor: Eric John Freeman, Sutton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/510,091

(22) Filed: Jul. 12, 2019

(65) Prior Publication Data

US 2021/0014633 A1 Jan. 14, 2021

(51) Int. Cl.

| | |
|---|---|
| ***H04R 1/28*** | (2006.01) |
| ***H04S 7/00*** | (2006.01) |
| ***H04R 3/08*** | (2006.01) |
| ***H04R 29/00*** | (2006.01) |

(52) U.S. Cl.

CPC ..... *H04S 7/307* (2013.01); *H04R 1/2842* (2013.01); *H04R 3/08* (2013.01); *H04R 29/001* (2013.01); *H04S 7/301* (2013.01)

(58) Field of Classification Search

CPC ..... H04R 1/2842; H04R 29/001; H04R 3/08; H04S 7/307; H04S 7/301

See application file for complete search history.

(56) References Cited

U.S. PATENT DOCUMENTS

| | | | | |
|---|---|---|---|---|
| 4,549,631 | A * | 10/1985 | Bose | H04R 1/2842 181/155 |
| 5,025,885 | A * | 6/1991 | Froeschle | H04R 1/2842 181/144 |
| 5,147,986 | A * | 9/1992 | Cockrum | H04R 1/2842 181/145 |
| 6,111,957 | A * | 8/2000 | Thomasson | H04R 29/00 381/103 |
| 8,256,566 | B1 * | 9/2012 | Rodgers | H04R 1/2826 181/144 |
| 2012/0308065 | A1 * | 12/2012 | Padalino | H04R 5/02 381/335 |
| 2013/0089215 | A1 * | 4/2013 | Kon | H04R 3/14 381/74 |
| 2017/0188134 | A1 * | 6/2017 | Lage | H04R 1/403 |

* cited by examiner

*Primary Examiner* — Ping Lee
(74) *Attorney, Agent, or Firm* — Hoffman Warnick LLC

(57) ABSTRACT

Various implementations include speaker systems. In a particular implementation, a speaker system includes: a first loudspeaker configured to drive at least one of a port or a passive radiator that is tuned at a first frequency; and a second loudspeaker configured to drive at least one of a port or a passive radiator that is tuned at a second frequency, the second frequency being higher than the first frequency, where the first loudspeaker is configured to output audio at the second frequency.

18 Claims, 8 Drawing Sheets

MULTI-TUNED SPEAKER SYSTEM

TECHNICAL FIELD

This disclosure generally relates to speaker systems. More particularly, the disclosure relates to speaker systems with at least two loudspeakers for driving enclosures tuned at distinct frequencies.

BACKGROUND

In most speaker systems (e.g., low profile speaker packages) maximum output is excursion limited in particular frequency ranges. That is, the maximum output of the speaker system is related to the peak displacement of the speaker cone, which is driven by the voice coil. The voice coil is attached to the basket by the spider, which allows the coil to move and drive the cone. In certain low profile speaker packages, the size of the spider is particularly limited, which in turn limits the displacement of the cone and consequently, the maximum output of the system. This creates many design challenges for system designers.

SUMMARY

All examples and features mentioned below can be combined in any technically possible way.

Various implementations include speaker systems. The speaker systems can include two distinct loudspeakers for driving a corresponding port or passive radiator. Each port or passive radiator is tuned at a distinct frequency, and a first one of the loudspeakers is configured to output audio at the frequency at which the second port or passive radiator is tuned.

In some particular aspects, a speaker system includes: a first loudspeaker configured to drive at least one of a port or a passive radiator that is tuned at a first frequency; and a second loudspeaker configured to drive at least one of a port or a passive radiator that is tuned at a second frequency, the second frequency being higher than the first frequency, where the first loudspeaker is configured to output audio at the second frequency.

In another aspect, a speaker system includes: a housing; a first loudspeaker at least partially within the housing, the first loudspeaker configured to drive at least one of a port or a passive radiator that is tuned at a first frequency; a second loudspeaker at least partially within the housing, the second loudspeaker configured to drive at least one of a port or a passive radiator that is tuned at a second frequency, the second frequency being higher than the first frequency, where the first loudspeaker is configured to output audio at the second frequency; and a digital signal processor (DSP) operatively coupled to both the first loudspeaker and the second loudspeaker, where the DSP is configured to apply phase compensation to align an acoustic phase of the first loudspeaker and corresponding port or passive radiator with an acoustic phase of the second loudspeaker and corresponding port or passive radiator.

Implementations can include one of the following features, or any combination thereof.

In various cases, the second loudspeaker is configured to not output audio at the first frequency.

In various implementations, the second loudspeaker is below port tuning at the first frequency.

In certain aspects, a high-pass filter reduces an input signal to the second loudspeaker at the first frequency.

In some implementations, the first loudspeaker is configured to drive a port that is tuned at the first frequency and the second loudspeaker is configured to drive a port that is tuned at the second frequency.

In certain cases, the first loudspeaker is configured to drive a passive radiator that is tuned at the first frequency and the second loudspeaker is configured to drive a passive radiator that is tuned at the second frequency.

In additional aspects, the first loudspeaker is configured to drive one of a port or a passive radiator that is tuned at the first frequency and the second loudspeaker is configured to drive the other of a port or a passive radiator that is tuned at the second frequency.

In particular aspects, the speaker system further includes a housing containing the first loudspeaker and the second loudspeaker.

In some implementations, the speaker system further includes at least one additional loudspeaker configured to drive the at least one of the port or the passive radiator that is tuned at the first frequency, where the at least one additional loudspeaker is configured to output audio at the second frequency.

In certain aspects, the at least one additional loudspeaker includes two or more loudspeakers.

In particular cases, the speaker system further includes at least one other loudspeaker configured to drive the at least one of a port or a passive radiator that is tuned at the second frequency.

In some aspects, the speaker system further includes a digital signal processor (DSP) operatively coupled to both the first loudspeaker and the second loudspeaker, where the DSP applies phase compensation to align an acoustic phase of the first loudspeaker and port with an acoustic phase of the second loudspeaker and port.

In additional cases, the DSP applies phase compensation to both the first loudspeaker and corresponding port or passive radiator and the second loudspeaker and corresponding port or passive radiator such that the acoustic output of the first and second loudspeakers and corresponding ports or passive radiators is aligned in phase.

In certain implementations, the second frequency is approximately one-half of an octave higher than the first frequency.

In particular cases, the second frequency is at most two-thirds of an octave higher than the first frequency.

In certain implementations, the second frequency is one-third to two-thirds of an octave higher than the first frequency.

In some aspects, the speaker system includes a soundbar, a wireless speaker, a home theater bass enclosure, a home theater satellite speaker or a microspeaker.

In additional implementations, both the first loudspeaker and the second loudspeaker are low frequency (LF) drivers.

In particular cases, at least one of the first loudspeaker or the second loudspeaker includes a full-range frequency loudspeaker or a mid-to-high frequency loudspeaker.

In certain implementations, the second frequency is in the range of frequencies where the first loudspeaker exhibits an in-band maximum in excursion per volt, just above the first tuning frequency.

Two or more features described in this disclosure, including those described in this summary section, can be combined to form implementations not specifically described herein.

The details of one or more implementations are set forth in the accompanying drawings and the description below.

Other features, objects and benefits will be apparent from the description and drawings, and from the claims.

Figure 1:
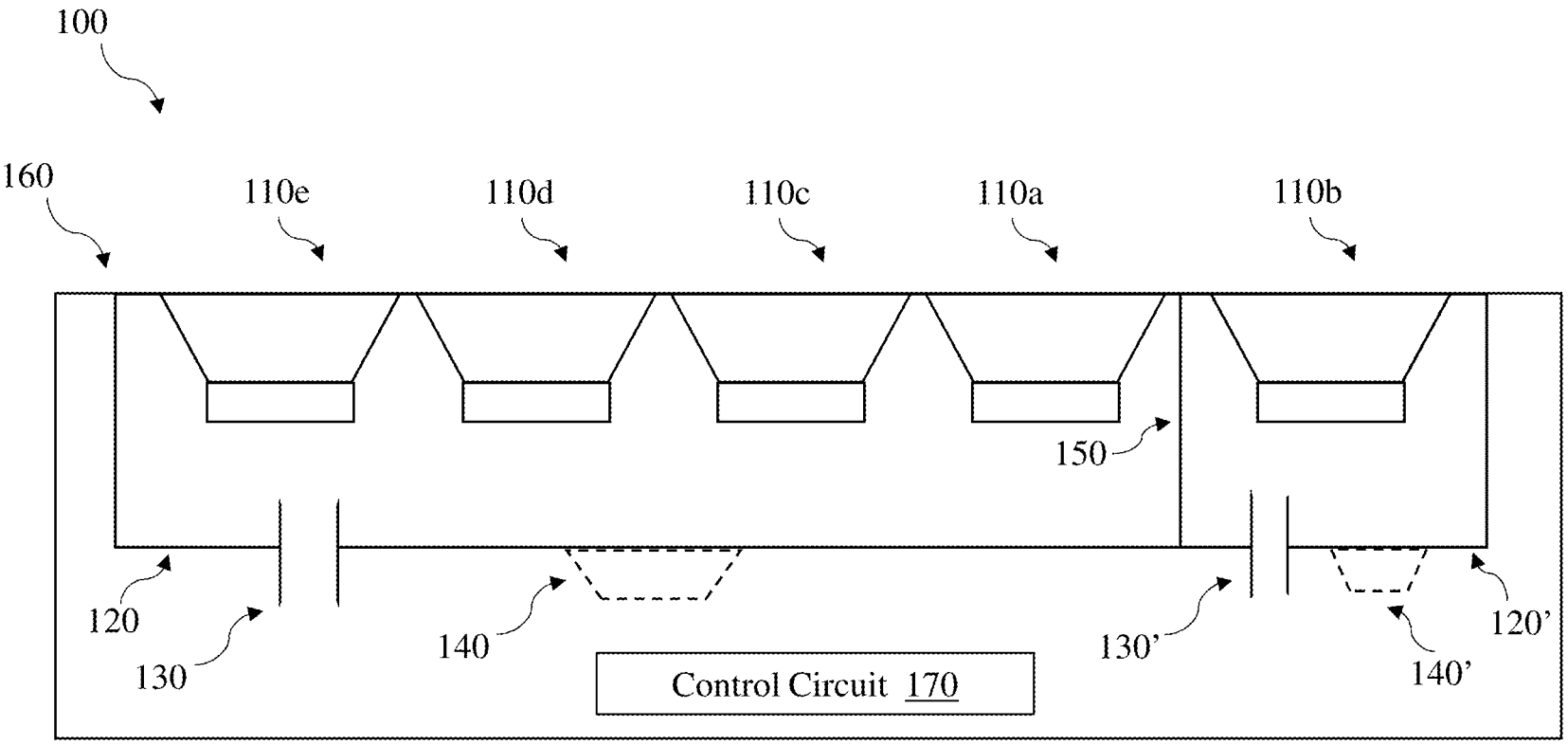
FIG. 1 shows a schematic depiction of a speaker system according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a speaker system (e.g., with two or more drivers) can be beneficially tuned such that at least one of the drivers is configured to drive a port and/or passive radiator at a frequency range where other driver(s) in the system are excursion limited. When compared with conventional systems, these speaker systems can provide greater acoustic output at low frequencies in certain applications, such as low-profile applications or any application where a driver is excursion limited.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value +/− a margin of error, such as a measurement error, which can range from up to 1-3 percent.

As described herein, as the size of speaker packages decreases, it becomes more challenging to increase acoustic output in particular frequency ranges. For example, in systems where drivers (e.g., low frequency, or LF drivers) are excursion limited, loudspeaker system designers must attempt to provide desired output within the smaller packages.

In contrast to conventional systems, the speaker systems (e.g., with two or more drivers) are tuned such that at least one of the drivers is configured to drive a port and/or passive radiator at a frequency range where other driver(s) in the system are excursion limited. In particular, the driver is configured to drive the port and/or passive radiator at a higher frequency than the other driver(s) to increase system output.

FIG. 1 shows a schematic depiction of a speaker system 100 including a plurality of loudspeakers (e.g., drivers) 110 for providing an acoustic output. In some cases, the speaker system 100 is part of a soundbar speaker system, whereby loudspeakers 110 are arranged linearly and may be arrayed to output audio in one or more directions. In other cases, the speaker system 100 is a wireless speaker, a home theater bass enclosure, a home theater satellite speaker, a micro-speaker, or any speaker configured to reproduce frequencies other than treble frequencies.

As depicted in this example implementation, the loudspeakers 110 are ported, such that each loudspeaker 110 is located in an enclosure 120 with a port (or vent) 130 for enabling higher output at lower frequencies. The loudspeakers 110 are configured to drive the port(s) 130, each of which is tuned at a particular frequency (e.g., frequency range). In some variations, the loudspeakers 110 can be configured to additionally, or alternatively, drive one or more passive radiators 140, depicted in phantom. In these cases, the loudspeakers 110 are configured to drive one or more ports 130 and/or one or more passive radiators 140 (which can include sub-components). In some cases, separately ported loudspeakers 110 (e.g., those loudspeakers driving different ports 130 and/or passive radiators 140) are located in separate enclosures 120 (e.g., as shown with separate enclosure 120' in FIG. 1). These separate enclosures 120 can be physically coupled with one another, e.g., as shown in FIG. 1 including a wall 150 separating enclosures 120 and 120'. In other cases, these separate enclosures 120 are physically isolated from one another, such that they not share a common interface.

The enclosure(s) 120 including the loudspeaker(s) 110 are located in a housing 160. The housing 160 can include additional electronic components such as interfaces and communications components (e.g., transceivers, network interfaces, etc.), as well as control components. Each loudspeaker 110 can be connected with a control circuit 170, located in the housing 160 for driving the motor in the loudspeaker 110 (e.g., by providing electrical signals to excite speaker diaphragm). The control circuit 170 is shown as a single controller unit for all of the loudspeakers 110. In certain cases, the control circuit is connected with each of the loudspeakers 110 by a hard-wired connection, which is not illustrated in this depiction. It is understood that in additional implementations, each loudspeaker 110, or subgroups of loudspeakers 110 can be connected with separate control circuits. In particular cases, the same control circuit 170 is connected to at least one of the loudspeakers 110 in a first grouping (e.g., in the first enclosure 120), and at least one of the loudspeakers in a second grouping (e.g., in the second enclosure 120'). As described herein, the control circuit(s) 170, where applicable, can include a processor and/or microcontroller, which in turn can include decoders, digital signal processor (DSP) hardware/software, etc. for playing back (rendering) audio content at the loudspeaker 110. The control circuit(s) 170 can also include one or more digital-to-analog (D/A) converters for converting the digital audio signal to an analog audio signal. This audio hardware can also include one or more amplifiers which provide amplified analog audio signals to the loudspeakers 110. In some cases, the DSP in the control circuit 170 is configured to apply one or more filters to align the acoustic phase of distinct loudspeakers 110 and ports 130. In more particular cases, the control circuit 170 includes multiple DSP hardware/software components for applying distinct DSP limiter tunings to loudspeakers in different enclosures 120, 120' or sections of the enclosure.

In some particular implementations, each of the loudspeakers 110 is a low frequency (LF) driver. However, in other implementations, at least one of the loudspeakers 110 is a full-range frequency driver, mid-range driver, or a mid-to-high frequency driver. In certain implementations, the speaker system 100 includes at least four loudspeakers 110.

Figure 2:
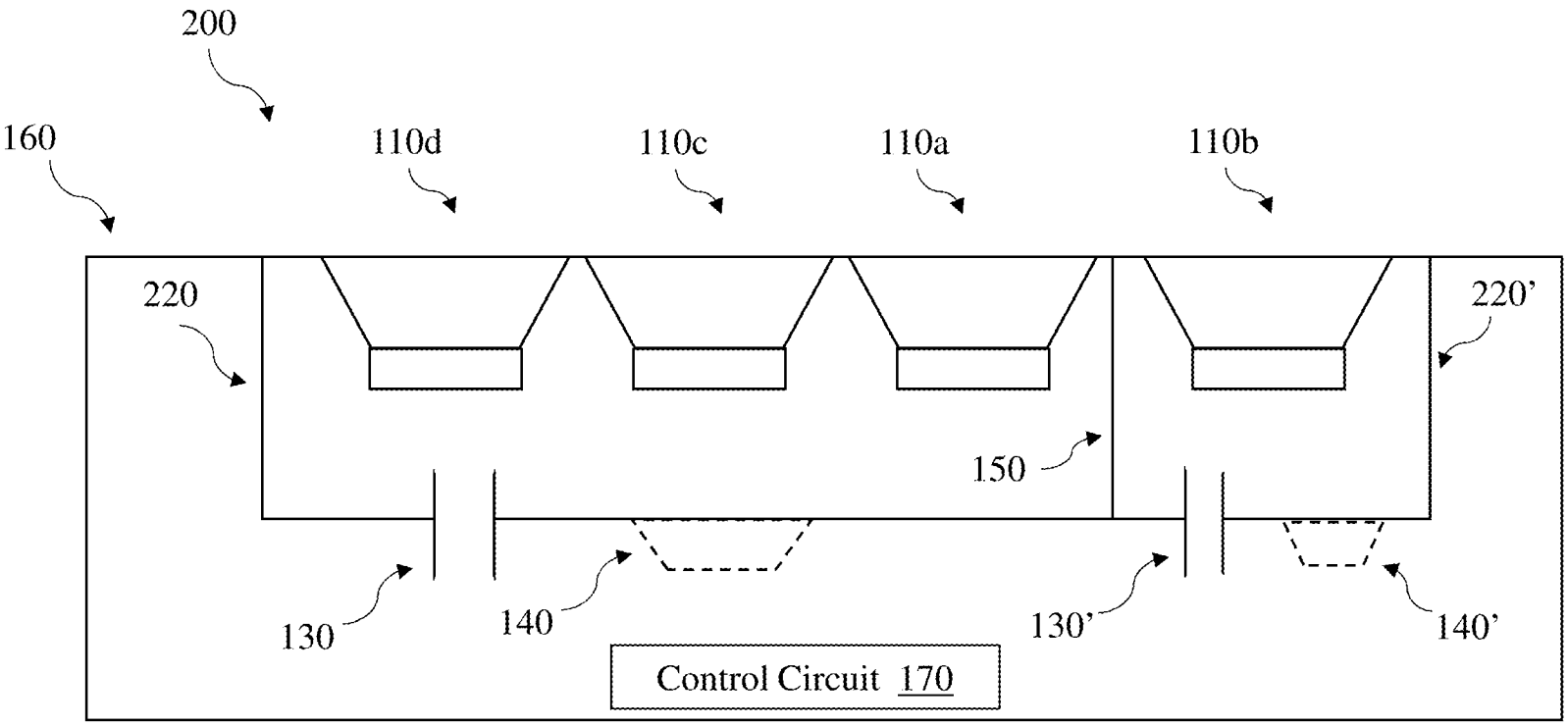
FIG. 2 shows a schematic depiction of a speaker system according to various additional implementations.
Figure 3:
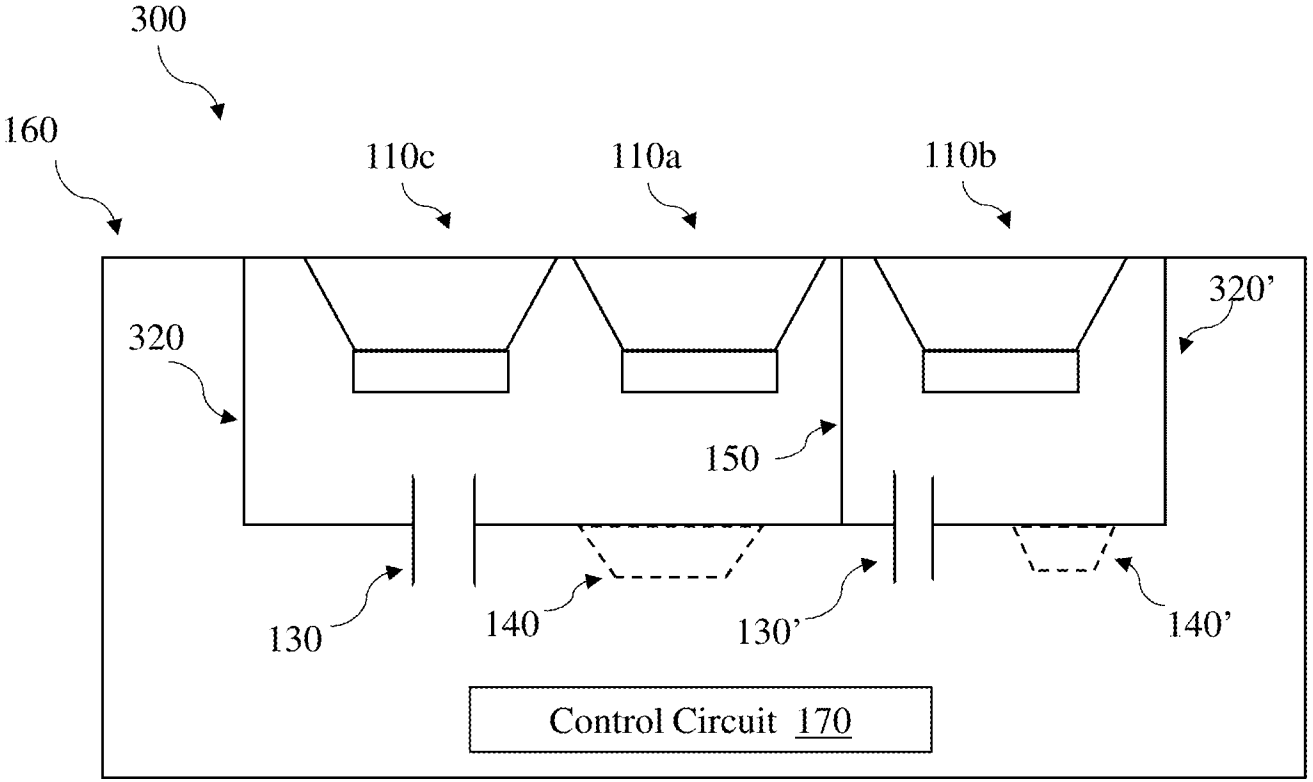
FIG. 3 a schematic depiction of a speaker system according to various further implementations.
Figure 4:
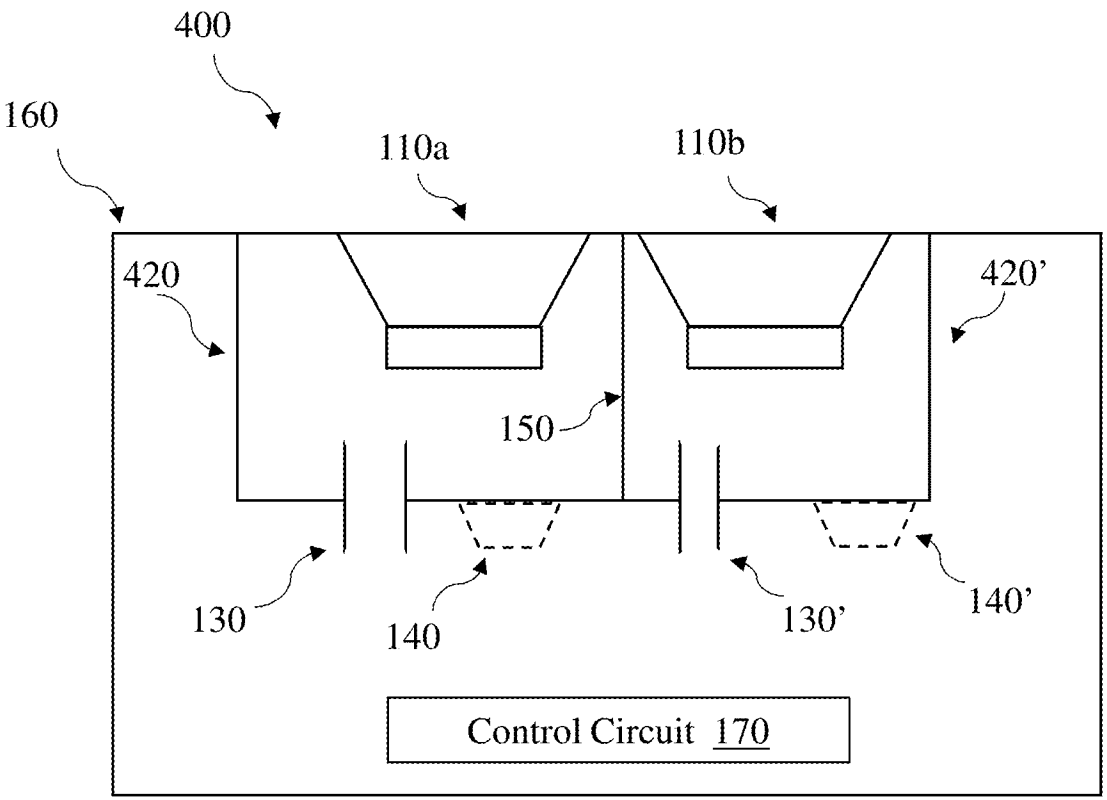
FIG. 4 shows a schematic depiction of a speaker system according to various additional implementations.

In the example implementation shown in FIG. 1, the speaker system 100 includes five loudspeakers 110*a-e*. However, additional implementations such as those shown in FIGS. 2-4 depict systems 200, 300, 400 having four, three and two loudspeakers 110, respectively. Differences in enclosure configuration (e.g., size, shape) between systems are indicated by distinct labels for those respective enclosures (e.g., enclosures 220, 320, 420, and in system 500, enclosure 520). Many aspects of these various systems can be explained concurrently, but particular attention is paid to speaker system 100 in FIG. 1. In all of the implementations disclosed herein, the speaker system has at least two loudspeakers 110*a*, 110*b*, each of which is an enclosed loudspeaker driving a port 130 and/or a passive radiator 140.

Returning to FIG. 1, according to various implementations, the speaker system 100 includes a first loudspeaker 110*a* that is configured to drive one or more ports 130 (one shown) and/or one or more passive radiators 140 (one shown) that is tuned at a first frequency. In the example of FIG. 1, additional loudspeakers 110*c-e* can also be configured to drive the port(s) 130 and/or passive radiator(s) 140 tuned at the first frequency. That is, all of the loudspeakers in enclosure section 120 can be configured to drive the port 130 and/or passive radiator 140. The speaker system 100 also includes a second loudspeaker 110*b* that is configured to drive one or more ports 130' (one shown) and/or one or more passive radiators 140' (one shown) tuned at a second, distinct frequency (and located in the additional enclosure 120'). That is, port(s) 130' and/or passive radiator(s) 140' are tuned to resonate in a frequency range where the first loudspeaker 110*a* (and additional loudspeakers 110*c-e*) are excursion-limited.

In various implementations, as noted herein, the second frequency is higher than the first frequency. In particular examples, the second frequency does not exceed 500 Hz. In other terms, the second frequency is at most two-thirds of an octave higher than the first frequency. In particular examples, the second frequency is approximately one-third to two-thirds of an octave higher than the first frequency. In more particular examples, the second frequency is approximately one-half of an octave higher than the first frequency. As is known in the art, an increase in one octave is equal to a doubling in frequency. For instance, in implementations where the second frequency is, e.g., at most one-half of an octave higher than the first frequency, if the first frequency is, e.g., 70 Hz, then the second frequency would be at most 105 (70 plus one-half of 70) Hz. In another example, if the second frequency is at least one-third of an octave higher than the first frequency, if the first frequency is, e.g., 60 Hz, then the second frequency would be at least 80 (60 plus one-third of 60) Hz. In yet another example, if the second frequency is one-third to two-thirds of an octave higher than the first frequency, if the first frequency is, e.g., 90 Hz, then the second frequency would be in the range of 120 (90 plus one-third of 90) Hz to 150 (90 plus two-thirds of 90) Hz. The difference in tuning between the port 130' and/or passive radiator 140' in one portion of the housing 160 (in enclosure 120') and the port 130 and/or passive radiator 140 in the other portion of the housing 160 (in enclosure 120) allows the speaker system 100 to increase output at lower frequency ranges, e.g., below 500 Hz, 400 Hz, 300 Hz, 200 Hz, and in some particular cases, around or below approximately 100 Hz.

The differences in tuning between the ports 130, 130' and/or passive radiators 140, 140' is determined by the dimensions of those components, as well as the dimensions of the enclosures 120, 120'. For example, differences in volume between enclosure 120 and enclosure 120' can result in the same sized port(s) and/or passive radiator(s) being tuned at distinct frequencies, e.g., where the enclosure 120 with lesser volume is tuned at a higher frequency. However, in various implementations, ports and/or passive radiators are chosen according to a number of acoustic parameters, and are not necessarily sized equally across enclosures.

During operation, the loudspeakers 110 are capable of operating at distinct frequencies, e.g., within a range. However, each group of loudspeakers 110 is configured to operate within a frequency range whose approximate lower limits correspond with the tuning of corresponding port(s) 130 and/or passive radiators 140. The control circuit 170 (including the DSP) is configured (e.g., programmed) to control operation of the loudspeakers 110 while operating across these frequency ranges. For example, the second loudspeaker 110*b* is configured to not output audio when operated at the first frequency (at which the first loudspeaker 110*a* is tuned). In other words, the second loudspeaker 110*b* is below port tuning (or passive radiator tuning) when operating at the first frequency. In these cases, the DSP in control circuit 170 includes a high-pass filter configured to reduce input signals to the second loudspeaker 110*b* when that second loudspeaker 110*b* is operated at the first frequency. In additional implementations, the control circuit 170 includes a nonlinear processing component to limit the voltage applied to loudspeakers 110. This processing component is configured to tailor the applied voltage to each loudspeaker 100 differently in frequency ranges above or below the tuning of each enclosure 120.

In cases where the second loudspeaker 110*b* is operating at the second, higher frequency (e.g., approximately one-third to two-thirds higher than the first frequency), the DSP in control circuit 170 applies phase compensation to align an acoustic phase of the first loudspeaker 110*a* and port 130 with an acoustic phase of the second loudspeaker 110*b* and port 130' such that these signals add constructively. That is, the DSP applies phase compensation to both the first loudspeaker 110*a* and the second loudspeaker 110*b*, such that the acoustic output of these loudspeakers 110*a,b* and corresponding ports 130, 130' and/or passive radiators 140, 140' is aligned in phase. In these cases, when operating at the second, higher frequency, the first loudspeaker 110*a* is at its approximate maximum excursion. That is, when operating at the second frequency, the cone on the first loudspeaker 110*a* is at its approximate maximum linear displacement along its motion axis. In other terms, the second frequency is in the range of frequencies where the first loudspeaker 110*a* exhibits an in-band maximum in excursion per volt, just above the first tuning frequency.

In particular examples, which are applicable to speaker systems 100, 200 and 300, at least one additional speaker (e.g., loudspeakers 110*c*, 110*d*, 110*e*) is configured to drive the port 130 and/or passive radiator 140 tuned at the first frequency. In some of these cases, that additional speaker (e.g., loudspeaker 110*c*, 110*d* and/or 110*e*) is configured to output audio at the second, higher frequency.

In one example, which is applicable to speaker systems 100, 200, 300, 400, the first frequency is approximately 70 Hz, and the second frequency is approximately 100 Hz (e.g., between ⅓ and ⅔ of an octave higher). In the particular example of system 100 in FIG. 1, when this system is operating at 70 Hz, four of the loudspeakers 110*a* and 110*c-e* are contributing output at below-maximum excursion by driving port 130 and/or passive radiator 140. In these cases, the control circuit 170 is configured to electrically shut off the loudspeaker 110*b*, which does not contribute output at this frequency. In this same example, when the speaker system 100 is operating at 100 Hz, loudspeakers 110*a* and 110*c-e* are contributing output at maximum excursion, and loudspeaker 110*b* is contributing output at below (e.g., low) excursion by driving port 130' and/or passive radiator 140'.

Figure 5:
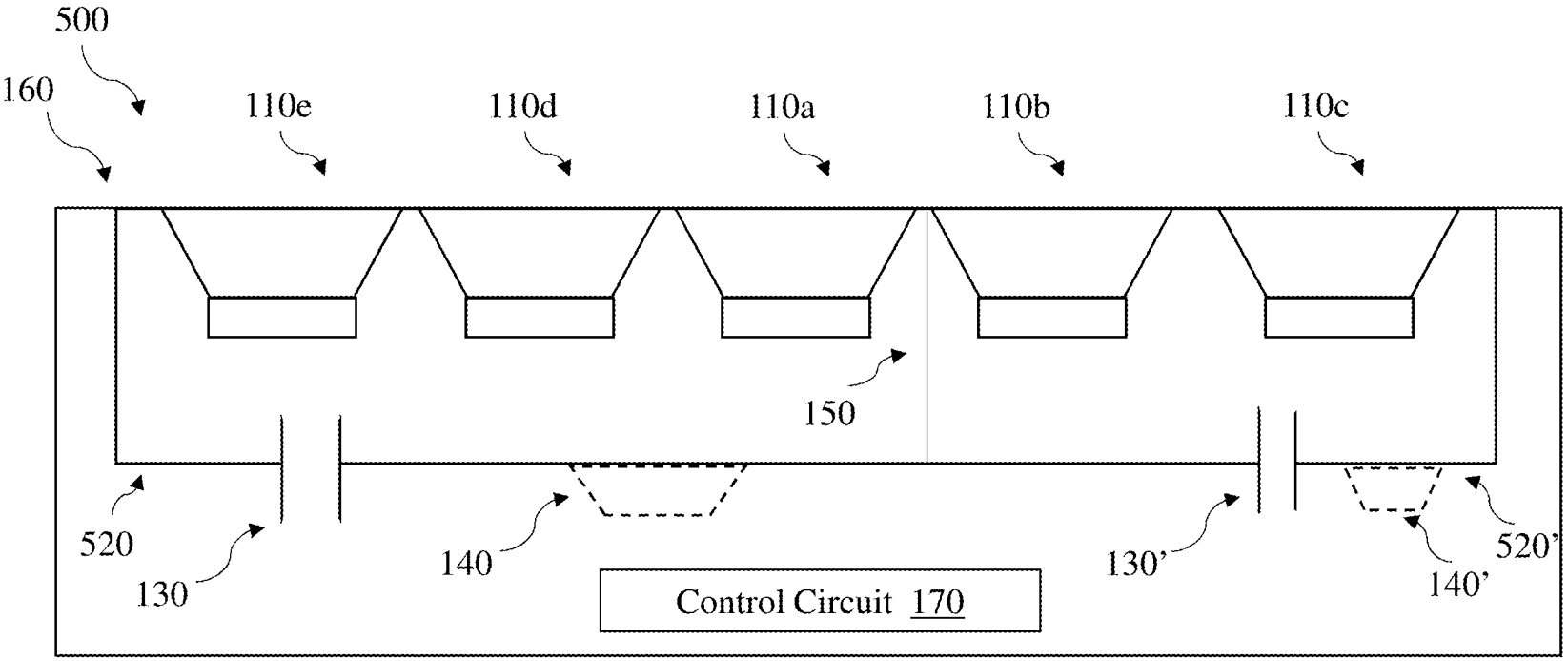
FIG. 5 shows a schematic depiction of another speaker system according to various implementations.

FIG. 5 shows an additional implementation of a speaker system 500 that includes an additional loudspeaker 110*c* that is configured to drive the port 130' and/or passive radiator 140' that is tuned at the second frequency. In this case, the additional loudspeaker 110*c* is located in enclosure 520', in addition to speaker 110*a*. It is understood that any number of additional loudspeakers can be located in enclosure 520' and configured to drive port 130' and/or passive radiator 140' tuned at the second frequency. In these cases, additional loudspeakers in enclosure 520' can further enhance the output of the speaker system 500 at and above the second frequency.

Figure 6:
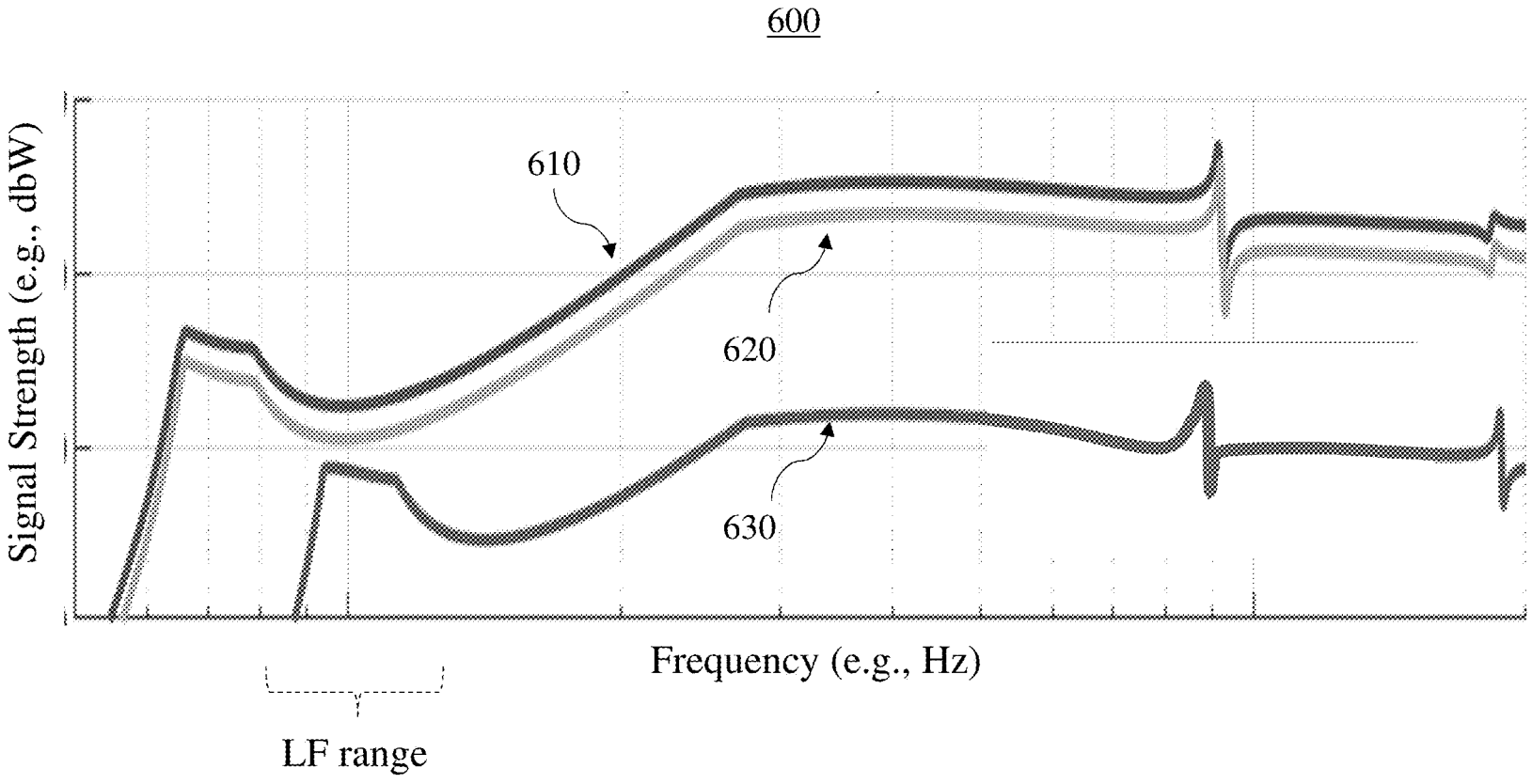
FIGS. 6-8 illustrate graphical plots of combined excursion-limited and voltage-limited acoustic output for the speaker systems disclosed herein as compared with a conventional speaker system.
Figure 7:
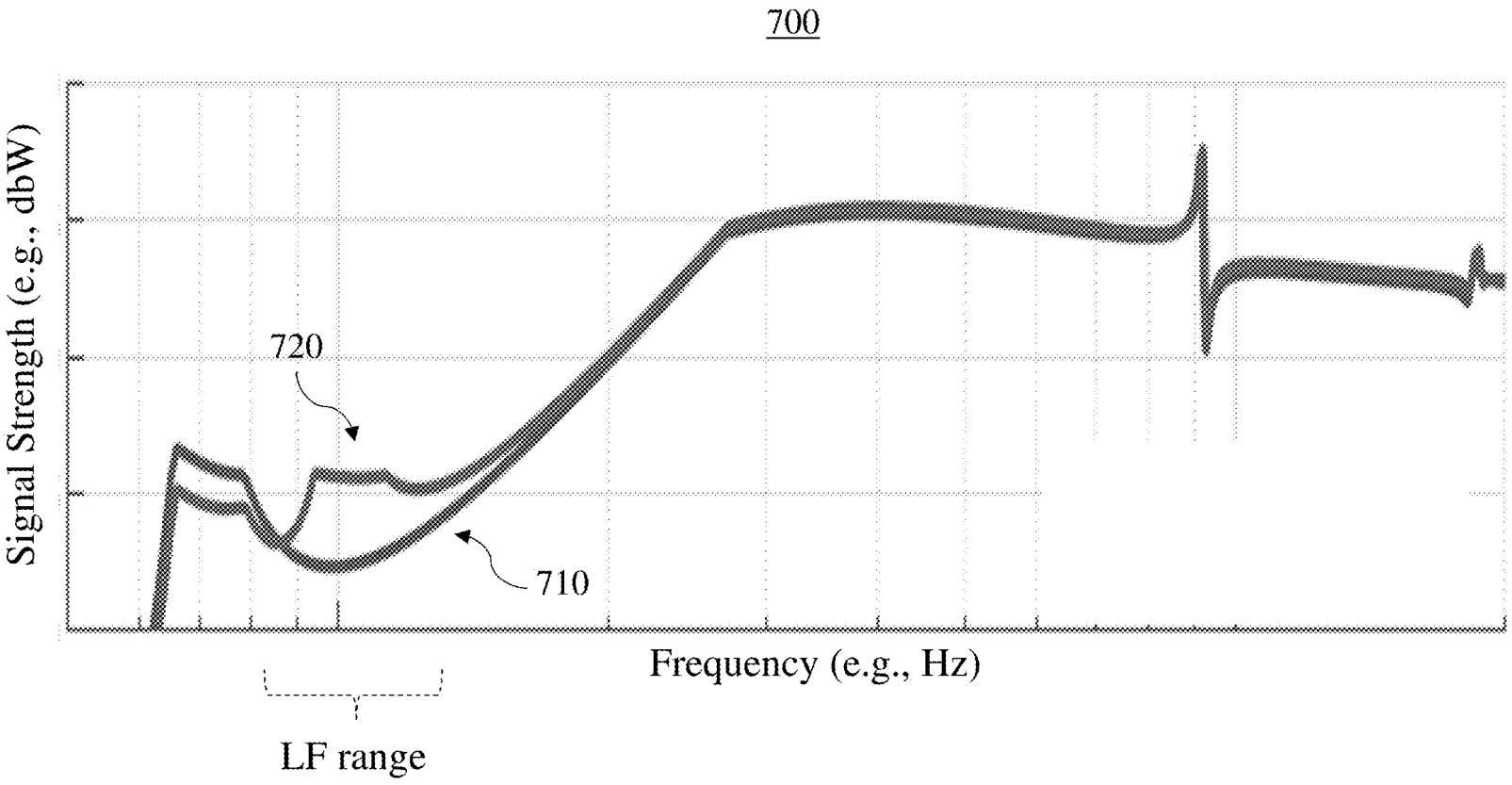
Figure 8:
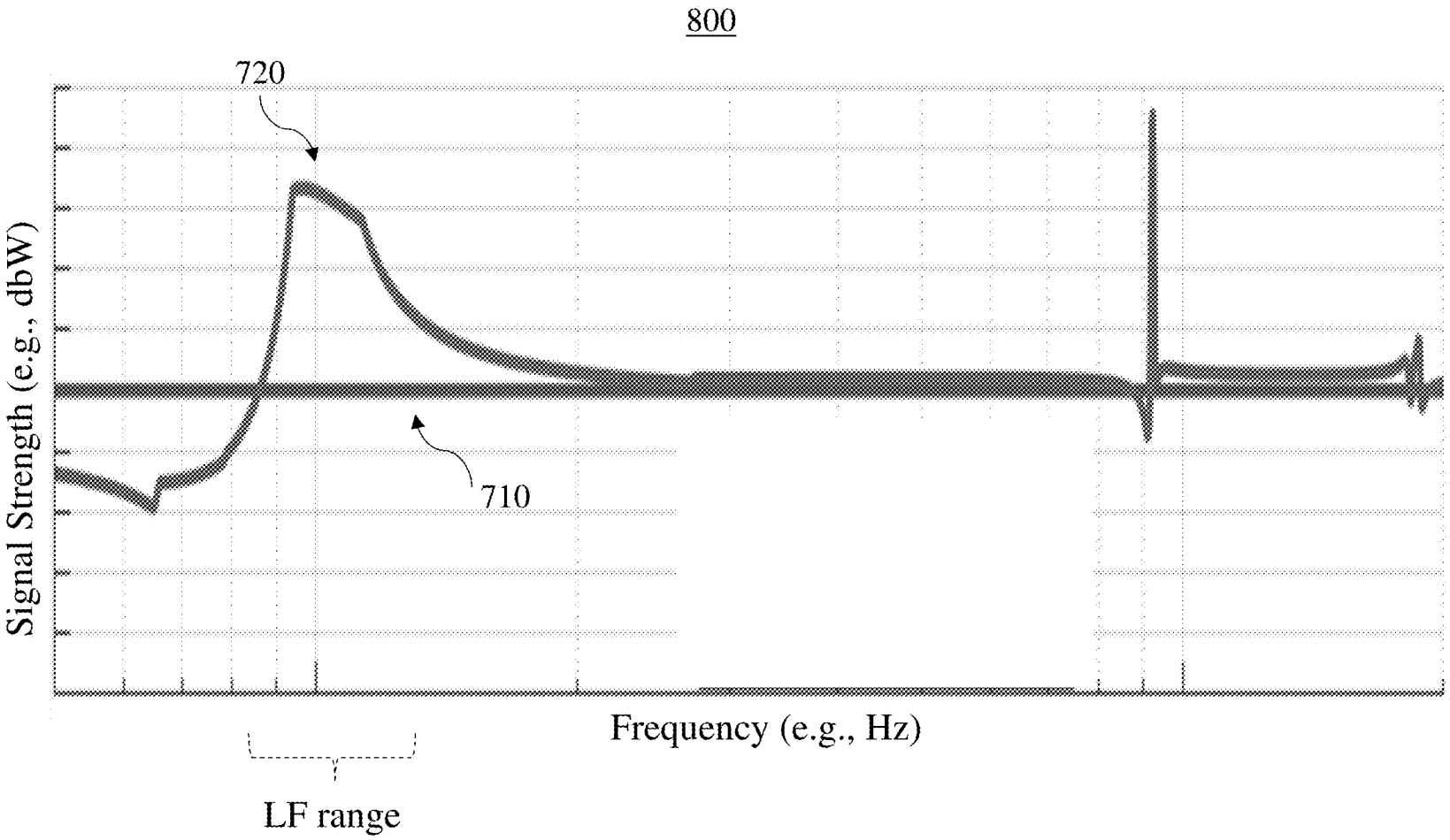

FIGS. 6-8 show example graphical plots illustrating the combined voltage- and excursion-limited maximum output for various loudspeaker systems in terms of signal strength (e.g., in decibel Watts, or dBW) versus frequency (e.g., Hertz). These plots show the combined excursion-limited and voltage-limited output of distinct speaker systems. In particular, these plots demonstrate the performance benefits of the various implementations disclosed herein (e.g., speaker system 100), for example, increased output at lower frequencies (e.g., a frequency range surrounding or otherwise including 100 Hz) with minimal tradeoffs in terms of output at frequencies below that frequency range. FIG. 6 shows graph 600, depicting the signal strength v. frequency response of a conventional five loudspeaker system (curve 610) all tuned at the same frequency, as compared with a four loudspeaker system tuned at a nominal (lower) frequency such as the first frequency (curve 620), and a single loudspeaker system tuned at an elevated frequency such as the second frequency (curve 630).

FIG. 7 shows graph 700, illustrating a comparison of the response of the conventional five loudspeaker system (curve 710) with a system similar to speaker system 100 (FIG. 1) having four loudspeakers driving an enclosure tuned to a first frequency and one loudspeaker driving an enclosure tuned to a second, higher frequency (curve 720). Similar to system 100, curve 720 depicts a system whereby the distinctly tuned loudspeaker enclosures are added together by a DSP using phase compensation. As shown in this depiction, the system similar to speaker system 100 has greater signal strength in the LF range than the conventional loudspeaker system with all loudspeakers driving an enclosure tuned to the same frequency. FIG. 8 shows a normalized depiction of the comparison between curves 710 and 720, illustrating that the increase in output (e.g., of several dBW) in the LF range is greater than the drop in output at frequencies below the LF range.

When compared with conventional speaker systems, as noted herein, the speaker systems disclosed according to various implementations can provide improved system output at lower frequencies, especially in excursion-limited systems such as low profile systems. The signal processing that drives the separate sections of these speaker systems can also include nonlinear processing, such as limiters, that is unique to each section.

One or more components in the speaker systems (e.g., loudspeakers) can be formed of any conventional loudspeaker material, e.g., a heavy plastic, metal (e.g., aluminum, or alloys such as alloys of aluminum), composite material, etc.

It is understood that the relative proportions, sizes and shapes of the speaker systems and components and features thereof as shown in the FIGURES included herein can be merely illustrative of such physical attributes of these components. That is, these proportions, shapes and sizes can be modified according to various implementations to fit a variety of products. For example, while substantially circular-shaped loudspeakers are be shown according to particular implementations, it is understood that the loudspeakers can also take on other three-dimensional shapes in order to provide acoustic functions described herein.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Elements of different implementations described herein can be combined to form other embodiments not specifically set forth above. Elements may be left out of the structures described herein without adversely affecting their operation. Furthermore, various separate elements may be combined into one or more individual elements to perform the functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications can be made without departing from the scope of the inventive concepts described herein, and, accordingly, other implementations are within the scope of the following claims.

I claim:

1. A speaker system comprising:

a first loudspeaker configured to drive at least one of a port or a passive radiator that is tuned at a first frequency, the first loudspeaker located in a first enclosure;

a second loudspeaker configured to drive at least one of a port or a passive radiator that is tuned at a second frequency, the second frequency being higher than the first frequency, the second loudspeaker located in a second enclosure, the second enclosure being separate from the first enclosure; and a common housing, wherein the first enclosure and the second enclosure are located within the common housing, wherein the first loudspeaker is configured to output audio at the second frequency, wherein the speaker system is a sound bard, wherein at least an end of said port or at least one surface of said passive radiator that is tuned at the first frequency is directly coupled to a space enclosed by said first enclosure and at least another end of said port or at least another surface of said passive radiator is directly coupled to a second space of the common housing, wherein at least an end of said port or at least one surface of said passive radiator that is tuned at the second frequency is directly coupled to a space enclosed by said second enclosure and at least another end of said port or at least another surface of said passive radiator is directly coupled to said second space of the common housing, wherein said second space is separated from the space enclosed by said first enclosure and the spaced enclosed by said second enclosure.

2. The speaker system of claim 1, wherein the second loudspeaker is configured to not output audio at the first frequency, wherein a high-pass filter reduces an input signal to the second loudspeaker at the first frequency.

3. The speaker system of claim 1, wherein the first loudspeaker is configured to drive a port that is tuned at the first frequency and the second loudspeaker is configured to drive a port that is tuned at the second frequency.

4. The speaker system of claim 3, wherein a difference in tuning between the port in the second enclosure in the housing and the port in the first enclosure in the housing is configured to increase output of the speaker system in frequency ranges at or below approximately 500 Hz.

5. The speaker system of claim 1, wherein the first loudspeaker is configured to drive a passive radiator that is tuned at the first frequency and the second loudspeaker is configured to drive a passive radiator that is tuned at the second frequency.

6. The speaker system of claim 5, wherein a difference in tuning between the passive radiator in the second enclosure in the housing and the passive radiator in the first enclosure of the housing is configured to increase output of the speaker system in frequency ranges at or below approximately 500 Hz.

7. The speaker system of claim 1, further comprising at least one additional loudspeaker configured to drive the at least one of the port or the passive radiator that is tuned at the first frequency, wherein the at least one additional loudspeaker is configured to output audio at the second frequency, wherein the at least one additional loudspeaker comprises two or more loudspeakers, the speaker system further comprising at least one other loudspeaker configured to drive the at least one of a port or a passive radiator that is tuned at the second frequency.

8. The speaker system of claim 1, further comprising a digital signal processor (DSP) operatively coupled to both the first loudspeaker and the second loudspeaker, wherein the DSP applies phase compensation to align an acoustic phase of the first loudspeaker and corresponding port or passive radiator with an acoustic phase of the second loudspeaker and corresponding port or passive radiator.

9. The speaker system of claim 1, wherein the second frequency is approximately ½ of an octave higher than the first frequency.

10. The speaker system of claim 1, wherein the second frequency is at most ⅔ of an octave higher than the first frequency.

11. The speaker system of claim 1, wherein both the first loudspeaker and the second loudspeaker are low frequency (LF) drivers, wherein the second frequency comprises a frequency range, and wherein while operating in the second frequency range, the first loudspeaker is at its approximate maximum excursion.

12. The speaker system of claim 1, wherein the first loudspeaker is configured to drive one of a port or a passive radiator that is tuned at the first frequency and the second loudspeaker is configured to drive the other of a port or a passive radiator that is tuned at the second frequency.

13. The speaker system of claim 1, further comprising:

at least one additional loudspeaker configured to drive the at least one of the port or the passive radiator that is tuned at the first frequency, wherein the at least one additional loudspeaker is configured to output audio at the second frequency.

14. The speaker system of claim 13, wherein the second frequency comprises a frequency range, and wherein while operating in the second frequency range, the first loudspeaker is at its approximate maximum excursion.

15. A speaker system comprising:

a common housing comprising a first enclosure and a second enclosure, the first enclosure being separate from the second enclosure within the common housing;

a first loudspeaker at least partially within the housing, the first loudspeaker located in the first enclosure, the first loudspeaker configured to drive at least one of a port or a passive radiator that is tuned at a first frequency;

a second loudspeaker at least partially within the housing, the second loudspeaker located in the second enclosure, the second loudspeaker configured to drive at least one of a port or a passive radiator that is tuned at a second frequency, the second frequency being higher than the first frequency, wherein the first loudspeaker is configured to output audio at the second frequency; and a digital signal processor (DSP) operatively coupled to both the first loudspeaker and the second loudspeaker, wherein the DSP is configured to apply phase compensation to align an acoustic phase of the first loudspeaker and the corresponding port or passive radiator with an acoustic phase of the second loudspeaker and the corresponding port or passive radiator, wherein the speaker system is a soundbar, wherein at least an end of said port or at least one surface of said passive radiator that is tuned at the first frequency is directly coupled to a space enclosed by said first enclosure and at least another end of said port or at least another surface of said passive radiator is directly coupled to a second space of the common housing, wherein at least an end of said port or at least one surface of said passive radiator that is tuned at the second frequency is directly coupled to a space enclosed by said second enclosure and at least another end of said port or at least another surface of said passive radiator is directly coupled to said second space of the common housing, wherein said second space is separated from the space enclosed by said first enclosure and the spaced enclosed by said second enclosure.

16. The speaker system of claim 15, wherein the second loudspeaker is configured to not output audio at the first frequency.

17. The speaker system of claim 15, wherein the first loudspeaker is configured to drive one of a port or a passive radiator that is tuned at the first frequency and the second loudspeaker is configured to drive the other of a port or a passive radiator that is tuned at the second frequency.

18. The speaker system of claim 15, wherein the second frequency is at most ⅔ of an octave higher than the first frequency.

* * * * *